US007018511B2

(12) United States Patent
Sears et al.

(10) Patent No.: US 7,018,511 B2
(45) Date of Patent: Mar. 28, 2006

(54) CROSSED-LINKED PULP AND METHOD OF MAKING SAME

(75) Inventors: Karl D. Sears, Jesup, GA (US); Michael E. Haeussler, Savannah, GA (US); Tina R. Solomon, Richmond Hill, GA (US)

(73) Assignee: Rayonier Products & Financial Services Company, Fernandina Beach, FL (US)

( * ) Notice: Subject to any disclaimer, the term of this patent is extended or adjusted under 35 U.S.C. 154(b) by 124 days.

(21) Appl. No.: 10/272,418

(22) Filed: Oct. 16, 2002

(65) Prior Publication Data

US 2004/0074616 A1 Apr. 22, 2004

Related U.S. Application Data

(63) Continuation-in-part of application No. 09/832,634, filed on Apr. 11, 2001, now Pat. No. 6,620,293.

(51) Int. Cl.
*D21H 17/15* (2006.01)
*D06M 13/192* (2006.01)

(52) U.S. Cl. ..... 162/157.6; 162/157.6; 162/168.1; 162/182; 162/184; 8/116.1; 8/493

(58) Field of Classification Search ..... 162/135, 162/136, 146, 157.1, 157.6, 157.7, 158, 164.1, 162/168.1, 169, 173, 179, 184, 186, 204, 162/182; 8/116.1, 120, 125, 127, 493; 527/103; 427/389.9, 391, 392; 604/374–378
See application file for complete search history.

(56) References Cited

U.S. PATENT DOCUMENTS

| | | | | |
|---|---|---|---|---|
| 3,526,048 | A | 9/1970 | Rowland et al. | |
| 3,932,209 | A | 1/1976 | Chatterjee | |
| 4,082,500 | A | 4/1978 | Ward et al. | |
| 4,399,275 | A | 8/1983 | Sears | |
| 4,608,305 | A | 8/1986 | Presto | |
| 4,820,307 | A | 4/1989 | Welch et al. | |
| 4,936,865 | A | 6/1990 | Welch et al. | |
| 4,975,209 | A | 12/1990 | Welch et al. | |
| 5,137,537 | A | 8/1992 | Herron et al. | |
| 5,139,530 | A | 8/1992 | Blanchard et al. | |
| 5,183,707 | A | 2/1993 | Herron et al. | |
| 5,190,563 | A | 3/1993 | Herron et al. | |
| 5,221,285 | A | 6/1993 | Andrews et al. | |
| 5,549,791 | A | 8/1996 | Herron et al. | |
| 5,720,737 | A * | 2/1998 | Hamajima et al. | 604/378 |
| 5,755,828 | A | 5/1998 | Westland | |
| 5,789,326 | A | 8/1998 | Hansen et al. | |
| 5,834,095 | A | 11/1998 | Dutkiewicz et al. | |
| 5,981,739 | A | 11/1999 | Anderson et al. | |
| 5,998,511 | A * | 12/1999 | Westland et al. | 524/13 |
| 6,068,619 | A | 5/2000 | Hamajijma et al. | |
| 6,120,888 | A | 9/2000 | Dolsey et al. | |
| 6,165,919 | A | 12/2000 | Yang | |
| 6,184,271 | B1 | 2/2001 | Westland et al. | |
| 6,248,879 | B1 | 6/2001 | Anderson et al. | |
| 6,264,791 | B1 * | 7/2001 | Sun et al. | 162/168.1 |

FOREIGN PATENT DOCUMENTS

| | | |
|---|---|---|
| JP | 4-9279496 | 10/1997 |

* cited by examiner

*Primary Examiner*—Eric Hug
(74) *Attorney, Agent, or Firm*—Kramer Levin Naftalis & Frankel LLP

(57) ABSTRACT

The invention provides a method for preparing cross-linked cellulosic fibers. A sheet of mercerized cellulosic fibers with a purity of at least 95% is treated with a solution containing a carboxylic acid cross-linking agent. The treated cellulosic fibrous material is dried and cured in sheet form to promote intrafiber cross-linking. Cross-linked fiber products produced are economic and possess good porosity, bulking characteristics, wet resiliency, absorption characteristics, low fines, low nits and low knots. The invention also includes blended cellulose compositions comprising a minor proportion of cross-linked mercerized cellulosic fibers and a major proportion of other cellulosic fibers. The invention further provides individualized, chemically cross-linked mercerized cellulosic fibers of high purity.

18 Claims, No Drawings

CROSSED-LINKED PULP AND METHOD OF MAKING SAME

RELATED APPLICATION

This application is a continuation-in-part of prior U.S. application Ser. No. 09/832,634, now U.S. Pat. No. 6,620,293, filed Apr. 11, 2001.

This invention relates to cross-linked cellulose pulp sheets having low knot and nit levels and excellent absorbency and wet resiliency properties. More particularly, this invention relates to the cross-linking of cellulosic pulp fibers in sheet form and a method making cross-linked cellulose pulp sheets having performance properties which are equivalent or superior to those comprised of fibers which are cross-linked in fluff or individualized fiber form.

BACKGROUND OF THE INVENTION

Within the specialty paper market there is a growing need for high porosity, high bulk, high absorbency pulps with superior wet resiliency. The filter, towel, and wipe industries particularly require a sheet or roll product having good porosity, absorbency and bulk, which is able to retain those properties even when wet pressed. A desirable sheet product should also have a permeability and/or absorbency which enables gas or liquid to readily pass through.

Pulps are cellulose products composed of cellulose fibers which, in turn, are composed of individual cellulose chains. Commonly, cellulose fibers are cross-linked in individualized form to impart advantageous properties such as increased absorbent capacity, bulk, and resilience to structures containing the cross-linked cellulose fibers.

I. CHEMICALS AS CROSS-LINKING AGENTS

Cross-linked cellulose fibers and methods for their preparation are widely known. Common cellulose cross-linking agents include aldehyde and urea-based formaldehyde addition products. See, for example, U.S. Pat. Nos. 3,224,926; 3,241,533; 3,932,209; 4,035,147; and 3,756,913. Because these commonly used cross-linkers, such as DMDHEU (dimethyloldihydroxy ethylene urea) or NMA (N-methylol acrylamide), can give rise to formaldehyde release, their applicability to absorbent products that contact human skin (e.g., diapers) has been limited by safety concerns. These cross-linkers are known to cause irritation to human skin. Moreover, formaldehyde, which persists in formaldehyde-cross-linked products, is a known health hazard and has been listed as a carcinogen by the EPA. To avoid formaldehyde release, carboxylic acids have been used for cross-linking. For example, European Patent Application EP 440,472 discloses utilizing carboxylic acids such as citric acid as wood pulp fiber cross-linkers.

For cross-linking cellulose pulp fibers, other polycarboxylic acids, i.e., $C_2$–$C_9$ polycarboxylic acids, specifically 1,2,3,4-butanetetracarboxylic (BCTA) or a 1,2,3-propane tricarboxylic acid, preferably citric acid, are described in EP 427,317 and U.S. Pat. Nos. 5,183,707 and 5,190,563. U.S. Pat. No. 5,225,047 describes applying a debonding agent and a cross-linking agent of polycarboxylic acid, particularly BCTA, to slurried or sheeted cellulose fibers. Unlike citric acid, 1,2,3,4-butane tetracarboxylic acid is considered too expensive for use on a commercial scale.

Cross-linking with polyacrylic acids, is disclosed in U.S. Pat. No. 5,549,791 and WO 95/34710. Described therein is the use of a copolymer of acrylic acid and maleic acid with the acrylic acid monomeric unit predominating.

Generally, "curing" refers to covalent bond formation (i.e., cross-link formation) between the cross-linking agent and the fiber. U.S. Pat. No. 5,755,828 discloses using both a cross-linking agent and a polycarboxylic acid under partial curing conditions to provide cross-linked cellulose fibers having free pendent carboxylic acid groups. The free carboxylic acid groups improve the tensile properties of the resulting fibrous structures. The cross-linking agents include urea derivatives and maleic anhydride. The polycarboxylic acids include, e.g., acrylic acid polymers and polymaleic acid. Importantly, the cross-linking agent in U.S. Pat. No. 5,755,828 has a cure temperature, e.g., of about 165° C. The cure temperature must be below the cure temperature of the polycarboxylic acids so that, through only partial curing, uncross-linked pendent carboxylic acid groups are provided. The treated pulp is defiberized and flash dried at the appropriate time and temperature for curing.

Intrafiber cross-linking and interfiber cross-linking have different applications. WO 98/30387 describes esterification and cross-linking of cellulosic cotton fibers or paper with maleic acid polymers for wrinkle resistance and wet strength. These properties are imparted by interfiber cross-linking. Interfiber cross-linking of cellulose fibers using homopolymers of maleic acid and terpolymers of maleic acid, acrylic acid and vinyl alcohol is described by Y. Xu, et al., in the Journal of the Technical Association of the Pulp and Paper Industry, TAPPI JOURNAL 81(11): 159–164 (1998). However, citric acid proved to be unsatisfactory for interfiber cross-linking. The failure of citric acid and the success of polymaleic acid in interfiber cross-linking shows that each class of polymeric carboxylic acids is unique and the potential of a compound or polymer to yield valuable attributes of commercial utility cannot be predicted. In U.S. Pat. No. 5,427,587, maleic acid containing polymers are similarly used to strengthen cellulose substrates. Rather than intrafiber cross-linking, this method involves interfiber ester cross-linking between cellulose molecules. Although polymers have been used to strengthen cellulosic material by interfiber cross-linking, interfiber cross-linking generally reduces absorbency.

Another material that acts as an interfiber cross-linker for wet strength applications, but performs poorly as a material for improving absorbency via intrafiber cross-linking is an aromatic polycarboxylic acid such as ethylene glycol bis (anhydrotrimellitate) resin described in WO 98/13545.

One material known to function in both applications (i.e., both interfiber cross-linking for improving wet-strength, and intrafiber cross-linking for improved absorbent and high bulk structures) is 1,2,3,4-butane tetracarboxylic acid. However, as mentioned above, it is presently too expensive to be utilized commercially.

Other pulps used for absorbent products included flash dried products such as those described in U.S. Pat. No. 5,695,486. This patent discloses a fibrous web of cellulose and cellulose acetate fibers treated with a chemical solvent and heat cured to bond the fibers. Pulp treated in this manner has high knot content and lacks the solvent resiliency and absorbent capacity of a cross-linked pulp.

Flash drying is unconstrained drying of pulps in a hot air stream. Flash drying and other mechanical treatments associated with flash drying can lead to the production of fines. Fines are shortened fibers, e.g., shorter than 0.2 mm, that will frequently cause dusting when the cross-linked product is used.

II. PROCESSES IN CROSS-LINKING CELLULOSE FIBERS

There are generally two different types of processes involved in treating and cross-linking pulps for various applications. In one approach, fibers are cross-linked with a cross-linking agent in individualized fiber form to promote intrafiber crosslinking. Another approach involves interfiber linking in sheet, board or pad form.

U.S. Pat. No. 5,998,511 discloses processes (and products derived therefrom) in which the fibers are cross-linked with polycarboxylic acids in individualized fiber form. After application of the crosslinking chemical, the cellulosic material is defiberized using various attrition devices so that it is in substantially individualized fibrous form prior to curing at elevated temperature (160–200° C. for varying time periods) to promote cross-linking of the chemical & the cellulose fibers via intrafiber bonds rather then interfiber bonds.

This mechanical action has its advantages. In specialty paper applications, "nits" are hard fiber bundles that do not come apart easily even when slurried in wet-laid operations. This process, in addition to promoting individualized fibers which minimize interfiber bonding during the subsequent curing step (which leads to undesirable "nits" from the conventional paper pulps used in this technology), also promotes curling and twisting of the fibers which when cross-linked stiffens them and thereby results in more open absorbent structures which resist wet collapse and leads to improved performance (e.g., in absorbent and high porosity applications).

However, even when substantially well defibered prior to crosslinking, in specialty paper applications "nits" can still be found in the finished product after blending with standard paper pulps to add porosity and bulk. When "nits" are cross-linked in this form, they will not come apart.

Despite the advantages offered by the cross-linking approach in individualized form, many product applications (e.g., particularly in wet-laid specialty fiber applications) require undesirable "nits" and "knots" to be minimized as much as possible. Knots differ from "nits" as they are fiber clumps that will generally not come apart in a dry-laid system, but will generally disperse in a wet laid system. Therefore, there is a need in the art to further minimize undesirable "nits" and "knots".

Interfiber crosslinking in sheet, board or pad form, on the other hand, also has its place. In addition to its low processing cost, the PCT patent application WO 98/30387 describes esterification and interfiber crosslinking of paper pulp with polycarboxylic acid mixtures to improve wet strength. Interfiber cross-linking to impart wet strength to paper pulps using polycarboxylic acids has also been described by Y. Yu, et. al., (Tappi Journal, 81(11), 159 (1998), and in PCT patent application WO98/13545 where aromatic polycarboxylic acids were used.

Interfiber crosslinking in sheet, board or pad form normally produces very large quantities of "knots" and "nits". Therefore, cross-linking a cellulosic structure in sheet form would be antithetical or contrary to the desired result, and indeed would be expected to maximize the potential for "nits" and "knots" resulting in poor performance in the desired applications.

Accordingly, there exists a need for an economical cross-linking process that produces cross-linked fibers that offer more superior wet strength and fewer "knots" and "nits" than current individualized cross-linking process. The present invention seeks to fulfill these needs and provides further related advantages.

SUMMARY OF THE INVENTION

In one aspect, this invention provides a method for preparing cross-linked cellulosic fibers in sheet form, the method comprising applying a cross-linking agent to a sheet of mercerized cellulosic fibers with a cellulose purity of at least about 90%, drying the cellulosic fiber sheet, and curing the cross-linking agent to form intrafiber rather than interfiber cross-links.

In another aspect, the present invention provides chemically cross-linked cellulosic fibers comprising mercerized cellulosic fibers in sheet form. In one embodiment, the polymeric carboxylic acid cross-linking agent is an acrylic acid polymer and, in another embodiment, the polymeric carboxylic acid cross-linking agent is a maleic acid polymer. In yet another embodiment, the present invention provides cross-linked cellulosic fibers comprising mercerized cellulosic fibers in sheet form cross-linked with a blend of polymeric carboxylic acid cross-linking agents and second cross-linking agent, preferably citric acid (a polycarboxylic acid).

Another aspect of the present invention provides a high bulk blended cellulose composition comprising a minor portion of mercerized high purity cellulose fibers which have been cross-linked with a polymeric carboxylic acid and a major proportion of uncross-linked cellulose fibers, such as standard paper grade pulps.

In yet another aspect, the present invention provides individualized, chemically cross-linked cellulosic fibers comprising high purity, mercerized individualized cellulosic fibers cross-linked with carboxylic acid cross-linking agents.

In still another aspect, the present invention provides absorbent structures that contain the sheeted, mercerized, high purity, carboxylic acid cross-linked fibers of this invention, and absorbent constructs incorporating such structures.

Advantageously, the invention economically provides cross-linked fibers having good bulking characteristics, good porosity and absorption, low fines, low nits, and low knots.

DETAILED DESCRIPTION OF THE INVENTION

The present invention is directed to a method for forming chemically cross-linked cellulosic fibers with mercerized pulp in sheet form with carboxylic acid cross-linking agents. Preferably, the mercerized pulp is a high purity pulp. As used herein, the term "high purity" pulp refers to pulp with at least about 90% α-cellulose content.

According to one embodiment, the mercerized cellulosic pulp fibers have an α-cellulose content of at least about 90% by weight, preferably at least about 95% by weight, more preferably at least about 97% by weight, and even more preferably at least about 98% by weight.

Suitable purified mercerized cellulosic pulps would include, for example, Porosanier-J-HP, available from Rayonier Performance Fibers Division (Jesup, Ga.), and Buckeye's HPZ products, available from Buckeye Technologies (Perry, Fla.). These mercerized softwood pulps have an alpha-cellulose purity of 95% or greater.

The cellulosic pulp fibers may be derived from a softwood pulp source with starting materials such as various pines (Southern pine, White pine, Caribbean pine), Western hemlock, various spruces, (e.g., Sitka Spruce), Douglas fir or mixture of same and/or from a hardwood pulp source with starting materials such as gum, maple, oak, eucalyptus, poplar, beech, or aspen or mixtures thereof.

Cross-linking agents suitable for use in the invention include homopolymers, copolymers and terpolymers, alone or in combination, prepared with maleic anhydride as the predominant monomer. Molecular weights can range from about 400 to about 100,000 preferably about 400 to about 4,000. The homopolymeric polymaleic acids contain the repeating maleic acid chemical unit —[CH(COOH)—CH(COOH)]$_n$—, where n is 4 or more, preferably about 4 to about 40. In addition to maleic anhydride, maleic acid or fumaric acid may also be used.

As used herein, the term "polymeric carboxylic acid" refers to a polymer having multiple carboxylic acid groups available for forming ester bonds with cellulose (i.e., crosslinks). Generally, the polymeric carboxylic acid crosslinking agents useful in the present invention are formed from monomers and/or comonomers that include carboxylic acid groups or functional groups that can be converted into carboxylic acid groups. Suitable crosslinking agents useful in forming the cross-linked fibers of the present invention include polyacrylic acid polymers, polymaleic acid polymers, copolymers of acrylic acid, copolymers of maleic acid, and mixtures thereof. Other suitable polymeric carboxylic acids include commercially available polycarboxylic acids such as polyaspartic, polyglutamic, poly(3-hydroxy)butyric acids, and polyitaconic acids. As used herein, the term "polyacrylic acid polymer" refers to polymerized acrylic acid (i.e., polyacrylic acid); "copolymer of acrylic acid" refers to a polymer formed from acrylic acid and a suitable comonomer, copolymers of acrylic acid and low molecular weight monoalkyl substituted phosphinates, phosphonates, and mixtures thereof; the term "polymaleic acid polymer" refers to polymerized maleic acid (i.e., polymaleic acid) or maleic anhydride; and "copolymer of maleic acid" refers to a polymer formed from maleic acid (or maleic anhydride) and a suitable comonomer, copolymers of maleic acid and low molecular weight monoalkyl substituted phosphinates, phosphonates, and mixtures thereof.

Polyacrylic acid polymers include polymers formed by polymerizing acrylic acid, acrylic acid esters, and mixtures thereof. Polymaleic acid polymers include polymers formed by polymerizing maleic acid, maleic acid esters, maleic anhydride, and mixtures thereof. Representative polyacrylic and polymaleic acid polymers are commercially available from Vinings Industries (Atlanta, Ga.) and BioLab Inc. (Decatur, Ga.).

Acceptable cross-linking agents of the invention are addition polymers prepared from at least one of maleic and fumaric acids, or the anhydrides thereof, alone or in combination with one or more other monomers copolymerized therewith, such as acrylic acid, methacrylic acid, crotonic acid, itaconic acid, aconitic acid (and their esters), acrylonitrile, acrylamide, vinyl acetate, styrene, a-methylstyrene, methyl vinyl ketone, vinyl alcohol, acrolein, ethylene and propylene. Polymaleic acid polymers ("PMA polymers") useful in the present invention and methods of making the same are described, for example, in U.S. Pat. Nos. 3,810,834, 4,126,549, 5,427,587 and WO 98/30387. In a preferred embodiment, the PMA polymer is the hydrolysis product of a homopolymer of maleic anhydride. In other embodiments of the invention, the PMA polymer is a hydrolysis product derived from a copolymer of maleic anhydride and one of the monomers listed above. Another preferred PMA polymer is a terpolymer of maleic anhydride and two other monomers listed above. Maleic anhydride is the predominant monomer used in preparation of the preferred polymers. The molar ratio of maleic anhydride to the other monomers is typically in the range of about 2.5:1 to 9:1.

Preferably, the polymaleic acid polymers have the formula:

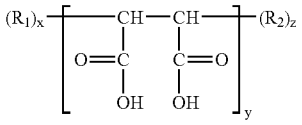

wherein $R_1$, and $R_2$ independently are H, $C_1$–$C_5$ alkyl, substituted or unsubstituted, or aryl, and x and z are positive rational number or 0, y is a positive rational number and x+y+2=1; y is generally greater than 0.5, i.e. greater than 50% of the polymer. In many instances it is desired that y be less than 0.9, i.e. 90% of the polymer. A suitable range of y, therefore, is about 0.5 to about 0.9. Alkyl, as used herein, refers to saturated, unsaturated, branched and unbranched alkyls. Substituents on alkyl or elsewhere in the polymer include, but are not limited to carboxyl, hydroxy, alkoxy, amino, and alkylthiol substituents. Polymers of this type are described, for example, in WO 98/30387 which is herein incorporated by reference.

Polymaleic acid polymers suitable for use in the present invention have number average molecular weights of at least 400, and preferably from about 400 to about 100,000. Polymers having an average molecular weight from about 400 to about 4000 are more preferred in this invention, with an average molecular weight from about 600 to about 1400 most preferred. This contrasts with the preferred range of 40,000–1,000,000 for interfiber cross-linking of paper-type cellulosics to increase wet strength (see, e.g., WO 98/30387 of C. Yang, p. 7; and C. Yang, TAPPI JOURNAL).

Non-limiting examples of polymers suitable for use in the present invention include, e.g., a straight chain homopolymer of maleic acid, with at least 4 repeating units and a molecular weight, e.g., of at least 400; a terpolymer with maleic acid predominating, with molecular weight of at least 400.

In one embodiment, the present invention provides cellulose fibers that are cross-linked in sheet form with a blend of cross-linking agents that include the polymaleic and polyacrylic acids described herein, and a second cross-linking agent. Preferred second cross-linking agents include polycarboxylic acids, such as citric acid, tartaric acid, maleic acid, succinic acid, glutaric acid, citraconic acid, maleic acid (and maleic anhydride), itaconic acid, and tartrate monosuccinic acid. In more preferred embodiments, the second cross-linking agent is citric acid or maleic acid (or maleic anhydride). Other preferred second cross-linking agents include glyoxal and glyoxylic acid.

A solution of the polymers is used to treat the cellulosic material. The solution is preferably aqueous. The solution includes carboxylic acids in an amount from about 2 weight percent to about 10 weight percent, preferably about 3.0 weight percent to about 6.0 weight percent. The solution has a pH preferably from about 1.5 to about 5.5, more preferably from about 2.5 to about 3.5.

The fibers, for example in sheeted or rolled form, preferably formed by wet laying in the conventional manner, are treated with the solution of crosslinking agent, e.g., by spraying, dipping, impregnation or other conventional application method so that the fibers are substantially uniformly saturated.

A cross-linking catalyst is applied before curing, preferably along with the carboxylic acids. Suitable catalysts for cross-linking include alkali metal salts of phosphorous containing acids such as alkali metal hypophosphites, alkali metal phosphites, alkali metal polyphosphonates, alkali metal phosphates, and alkali metal sulfonates. A particularly preferred catalyst is sodium hypophosphite. A suitable ratio of catalyst to carboxylic acids is, e.g., from 1:2 to 1:10, preferably 1:4 to 1:8.

Process conditions are also intended to decrease the formation of fines in the final product. In one embodiment, a sheet of wood pulp in a continuous roll form, is conveyed through a treatment zone where cross-linking agent is applied on one or both surfaces by conventional means such as spraying, rolling, dipping or other impregnation. The wet, treated pulp is then dried. It is then cured to effect cross-linking under appropriate thermal conditions, e.g., by heating to elevated temperatures for a time sufficient for curing, e.g. from about 175° C. to about 200° C., preferably about 185° C. for a period of time of about 5 min. to about 30 min., preferably about 10 min. to about 20 min., most preferably about 15 min. Curing can be accomplished using a forced draft oven.

Drying and curing may be carried out, e.g., in hot gas streams such as air, inert gases, argon, nitrogen, etc. Air is most commonly used.

The cross-linked fibers can be characterized as having fluid retention values by GATS (Gravimetric Absorption Testing System) evaluation preferably of at least 9 g/g, more preferably at least 10 g/g, even more preferably at least 10.5 g/g or higher, and an absorption rate of at least 0.25 g/g/sec, more preferably at least 0.3 g/g/sec or higher than 0.3 g/g/sec. The cross-linked fibers also have good fluid acquisition time (i.e., fast fluid uptake).

Resulting cross-linked fibrous material prepared according to the invention can be used, e.g., as a bulking material, in high bulk specialty fiber applications which require good absorbency and porosity. The cross-linked fibers can be used, for example, in non-woven, fluff absorbent applications. The fibers can be used independently, or preferably incorporated into other cellulosic materials to form blends using conventional techniques. Air laid techniques are generally used to form absorbent products. In an air laid process, the fibers, alone or combined in blends with other fibers, are blown onto a forming screen. Wet laid processes may also be used, combining the cross-linked fibers of the invention with other cellulosic fibers to form sheets or webs of blends. Various final products can be made including acquisition layers or absorbent cores for diapers, feminine hygiene products, and other absorbent products such as meat pads or bandages; also filters, e.g., air laid filters containing 100% of the cross-linked fiber composition of the invention. Towels and wipes also can be made with the fibers of the invention or blends thereof. Blends can contain a minor amount of the cross-linked fiber composition of the invention, e.g., from about 5% to about 40% by weight of the cross-linked composition of the invention, or less than 20 wt. %, preferably from about 5 wt. % to about 10 wt. % of the cross-linked composition of the invention, blended with a major amount, e.g., about 95 wt. % to about 60 wt. %, of uncross-linked wood pulp material or other cellulosic fibers, such as standard paper grade pulps.

There are several advantages in the present invention for cross-linking in sheet form besides being more economical. As noted above, cross-linking a cellulosic structure in sheet form would be expected to increase the potential for interfiber cross-linking which leads to "nits" and "knots" resulting in poor performance in the desired application. Thus, it was unexpected to find that high purity mercerized pulp cross-linked in sheet or board form actually yields far fewer "knots" ("nits" are a sub-component of the total "knot" content) than control pulps having conventional cellulose purity. When a standard purity fluff pulp, Rayfloc-J, was cross-linked in sheet form, the "knot" content went up substantially indicating increased deleterious interfiber bonding and examination of these "knots" recovered by classification showed they contained true "nits" (hard fiber bundles). Significantly, cross-linked pulp sheets according to the invention were found to contain far fewer knots than a commercial cross-linked pulp product of the Weyerhaeuser Company commonly referred to as HBA (for high-bulk additive) and a cross-linked pulp utilized in absorbent products by Proctor & Gamble ("P&G"), both of which are products cross-linked in "individualized" fibrous form using standard fluff pulps to minimize interfiber cross-linking.

When the cross-linked Porosanier sheeted pulps (prepared from wet laid pulp sheets using the preferred methodology described herein) were wet-blended with conventional paper pulp, Georgianier-J, at the 20% level to make handsheets for various tests to compare with handsheets similarly prepared using Weyerhaueser's HBA, readily visible "nits" were observed in the handsheets containing the HBA product, unlike those handsheets containing crosslinked Porosanier which were homogeneous in appearance with no visible "nits".

In diaper acquisition layer (AL) tests, where ability of the fibers to resist wet collapse upon multiple fluid insults (i.e., good wet resiliency) is important, it was observed that crosslinking of a conventional purity pulp (i.e., Rayfloc-J) in sheet form gave poor results compared to the commercial Proctor & Gamble AL material which is crosslinked with citric acid (the "Proctor & Gamble AL material" or the "P&G AL material"). However, crosslinking of Porosanier-J-HP in sheet form gave much better results relative to Rayfloc-J. In fact, it was found that using high purity cellulose Porosanier sheets that are wet-laid in a non-homogeneous (or irregular manner) produced substantially better results than Porosanier sheets that are more uniform and homogeneous in nature. At equal basis weight, as well as average density levels, the Porosanier sheets are much softer and have areas in them that are more open as a result of more varied density throughout the dry sheet structure. The AL results on pads prepared from these cross-linked, non-homogeneous Porosanier sheets gave results that outperformed Proctor & Gamble citric acid cross-linked fibers on an overall basis, being about equal in acquisition times, but superior in rewet properties.

In another aspect of the invention, high purity mercerized pulp is cross-linked in individualized fibrous form using currently available approaches to obtain a product that is superior in acquisition time to those derived from conventional purity pulp used in current industrial practice. The rewet property, however, is poorer. The sheet treatment process of the instant invention offers an advantage of improved rewet properties.

Another benefit of using high purity cellulose pulp to produce cross-linked pulp or pulp sheet according to the invention is that because the color forming bodies are substantially removed (i.e., the hemicelluloses & lignins), the cellulose is more stable to color reversion at elevated temperature. Since polycarboxylic acid cross-linking of cellulose requires high temperatures (typically around 185° C. for 10–15 minutes), this can lead to substantial discoloration with the conventional paper (or fluff) pulps that are presently used. In product applications where pulp brightness is an issue, the use of high purity cellulose pulp according to the invention offers additional advantages.

Another highly important benefit of the present invention is that cross-linked cellulose pulp sheets made in accordance with the invention enjoy the same or better performance characteristics as conventional individualized cross-linked cellulose fibers, but avoid the processing problems associated with dusty individualized cross-linked fibers.

To evaluate products obtained and described by the present disclosure as well as the invention herein, several tests were used to characterize cross-linked wood pulp product performance improvements resulting from the presently described method, and to describe some of the analytical properties of the products.

The invention will be illustrated but not limited by the following examples:

EXAMPLES

In the below examples, industry-employed standard test procedures have been used. Terms used in the examples are defined as follows:

Rayfloc®-J-LD (low density) is untreated southern pine kraft pulp sold by Rayonier Performance Fibers Division (Jesup, Ga. and Fernandina Beach, Fla.) for use in products requiring good absorbency, such as absorbent cores in diapers.

Georgianier-J® is a general purpose southern kraft pulp with high tear resistance sold by Rayonier Specialty Pulp Products.

Belclene® 200 is a straight chain polymaleic acid (PMA) homopolymer with a molecular weight of about 800 sold by BioLab Industrial Water Additives Division of BioLab Inc. (Decatur, Ga., a subsidiary of Great Lakes Corp).

Belclene® 283 is a polymaleic acid copolymer with molecular weight of about 1000 sold by BioLab Industrial Water Additives Division.

Belclene® DP-60 is a mixture of polymaleic acid terpolymer with the maleic acid monomeric unit predominating (molecular weight of about 1000) and citric acid sold by BioLab Industrial Water Additives Division.

Belclene® DP-80 is also a mixture of polymaleic acid terpolymer with the maleic acid monomeric unit predominating (molecular weight of about 1000) and citric acid sold by BioLab Industrial Water Additives Division; this material contains a higher level of citric acid than DP-60.

Evaluations with the Gravimetric Absorption Testing System (GATS) were carried out using a standard, single port radial wicking procedure. Pads are pressed to 3 g/cc density and tested under a 0.5 psi load for 12 minutes.

The "freeswell" test is done by putting about two grams of the fiber into a cloth teabag and sealing it. The teabag is then placed into a 0.9% saline solution and allowed to soak for 30 minutes before withdrawing the teabag and hanging it up to drip dry for 10 minutes before weighing. The amount of solution retained in the fibers is then determined. A teabag is also similarly run containing no fiber, and serves as a blank. This value obtained for each sample (minus the value for the "blank") is referred to as the "freeswell". Next, these teabags are placed in a centrifuge and spun for 5.0 minutes at 1400 rpm. The teabags are then weighed, and the amount of liquid remaining with the fibers is used to determine water retention (g of fluid/g of pulp) after centrifuging under these conditions.

Fiber quality evaluations were carried out on an Op Test Fiber Quality Analyzer (Op Test Equipment Inc., Waterloo, Ontario, Canada). It is an optical instrument that has the capability to measure average fiber length, kink, curl, and fines content.

In Johnson Classifier evaluations cited below, a sample in fluff form is continuously dispersed in an air stream. During dispersion, loose fibers pass through a 14 mesh screen (1.18 mm) and then through a 42 mesh (0.2 mm) screen. Pulp bundles (knots) which remain in the dispersion chamber and those that get trapped on the 42 mesh screen are removed and weighed. The former are called "knots" and the latter "accepts". The combined weight of these two is subtracted from the original weight to determine the weight of fibers that passed through the 0.2 mm screen. These fibers are referred to as "fines".

Properties measured include pressed and unpressed bulk (cc/g), Frazier porosity ($mL/cm^2/sec$), GATS absorption determined in terms of fluid retention (g/g) and absorption rate (g/g/sec), tensile strength ($Nm^2/g$), fiber properties including percent fines (using an Op Test Fiber Quality Analyzer), and fluff analysis including percent knots, accepts and fines (using a Johnson Classifier).

Example 1

Three different commercial Belclene® products from BioLab (BioLab Industrial Water Additives Division, Decatur, Ga.) were evaluated for their ability to improve absorption properties of Rayfloc-J. It is important that a cross-linked product ultimately have good absorption properties and therefore GATS absorption performance was used at the outset as a major criterion for performance. Belclene® 200 is an aqueous solution containing a straight chain polymaleic acid homopolymer with a molecular weight of about 800. Belclene® 283 is an aqueous solution containing a polymaleic acid terpolymer with a molecular weight of about 1000. Belclene® DP-60 is an aqueous solution containing a mixture of a polymaleic acid terpolymer and citric acid.

Rayfloc-J stock was impregnated with a solution of the chemical, including sodium hypophosphite catalyst ($NaH_2PO_2.H_2O$), at a 3.0% consistency slurry adjusted to pH 3.0.

Pulps were then recovered using a centrifuge and weighed to determine the amount of additive present prior to air-drying. The pulps were air-dried and fluffed in a Kamas hammermill prior to curing in a forced draft oven at 185° C. for 15 minutes. GATS testing was carried out using a standard, single port radial wicking procedure. Pads were pressed to a 0.3 g/cc density and tested under a 0.5 psi load for 12 minutes. All reported values in Table 1 are an average of three replicate tests.

TABLE 1

Initial Screening Results of Rayfloc-J, Cross-Linked with Belclene Products

| | | | | GATS Test Data | |
|---|---|---|---|---|---|
| Sample No. | Chemical Added | Solution pH | Catalyst Ratio[a] | Retention (g/g) | Absorption Rate (g/g/sec) |
| 1 | Rayfloc-J Control | | | 6.6 | 0.21 |
| 2 | 5.5% Belclene 200 | 3.0 | 1:4 | 9.6 | 0.43 |
| 3 | 5.6% Belclene 283 | 3.0 | 1:4 | 10.7 | 0.42 |
| 4 | 5.7% Belclene DP-60 | 3.0 | 1:4 | 10.4 | 0.49 |

[a]Ratio indicates parts of sodium hypophosphite catalyst to parts of added chemical (solids basis).

The rate of absorption is the most critical factor in determining absorption improvement, with fluid retention (or capacity) being second. Of the three Belclene products it is noted that DP-60 performs best.

Example 2

In an initial series of studies to evaluate the effect of key variables on DP-60 cross-linking performance, effect of catalyst ratio at DP-60 treatment levels of about 4% on Rayfloc-J were first examined. The results in Table 2 below tend to show that a 1:6 catalyst ratio gives slightly enhanced performance.

TABLE 2

Effect of Catalyst Ratios[a] GATS Absorbent Performance

| Sample No. | Description | Retention (g/g) | Absorption Rate (g/g/sec) |
|---|---|---|---|
| 5 | 4.1% DP-60, 1:4 catalyst: DP-60 | 11.07 | 0.34 |
| 6 | 4.0% DP-60, 1:6 catalyst: DP-60 | 11.49 | 0.38 |
| 7 | 4.1% DP-60, 1:8 catalyst: DP-60 | 11.16 | 0.33 |
| 8 | 4.0% DP-60, 1:10 catalyst: DP-60 | 10.60 | 0.36 |

[a]Sodium hypophosphite; chemical and pulp slurry pH of 3.0.

Example 3

Effect of slurry pH on performance was also examined. The cross-linking chemical must be applied in acidic form since acid conditions are required to promote effective cross-linking. However, the pH should not be very low to ensure that pH of the cross-linked product is in a nominally safe and natural range. From Table 3 below, it appears that a slurry pH of chemical and pulp of about 2.5 may give accentuated results. Results in Table 3 were acquired on samples prepared using 1:4 catalyst:DP-60 ratios.

TABLE 3

Effect of pH with DP-60 @ 4.0–4.1%[a] GATS Absorbent Performance

| Sample No. | Description | Retention (g/g) | Absorption Rate (g/g/sec) |
|---|---|---|---|
| 5 | 4.1% DP-60, pH 3.0 | 11.07 | 0.34 |
| 9 | 4.0% DP-60, pH 2.5 | 11.50 | 0.36 |
| 10 | 4.1% DP-60, pH 2.0 | 10.75 | 0.35 |

[a]1:4 catalyst:DP-60

Example 4

The effect of pH was examined again, using Rayfloc-J in the 3.4–3.5% DP-60 treatment range using the preferred catalyst ratio of 1:6. The results in Table 4 below again suggest that pH 2.5 gives the best results. However, for overall safety considerations, pH 3.0 is used.

Table 4 also includes data for a commercial sample of Weyerhaueser's HBA-NHB416 ("High Bulk Additive" cross-linked fiber available from Weyerhaeuser Co., Tacoma, Wash.) which was tested for comparative purposes. This material did not perform as well as Sample Nos. 11 and 12. It is believe that the chemistry of the HBA Sample (it is prepared using DMDHEU) may have adversely affected its performance.

TABLE 4

Effect of pH with DP-60 @ 3.4–3.5%[a] GATS Absorbent Performance

| Sample No. | Description | Retention (g/g) | Absorption Rate (g/g/sec) |
|---|---|---|---|
| 11 | 3.5% DP-60, pH 3.0 | 10.40 | 0.39 |
| 12 | 3.4% DP-60, pH 2.5 | 10.64 | 0.43 |
| HBA | Commercial Sample | 10.26 | 0.26 |

[a]1:6 catalyst:DP-60

Example 5

Using the optimum conditions arrived with DP-60, the best curing times at 185° C. was also investigated. Rayfloc-J treated with 4.0% of DP-60 was prepared, and then samples were cured in a forced draft oven for 5, 10, and 15 minute intervals. The GATS test results below (Table 5) show that curing times of from 10–15 minutes are preferred.

TABLE 5

Rayfloc-J Treated with 4.0% DP-60 then Cured for 5, 10 and 15 Minutes at 185° C. (Forced Draft Oven)[a] GATS Absorbent Performance

| Sample No. | Description | Retention (g/g) | Absorption Rate (g/g/sec) |
|---|---|---|---|
| 13 | 5 minute cure | 8.61 | 0.34 |
| 14 | 10 minute cure | 10.19 | 0.42 |
| 15 | 15 minute cure | 11.13 | 0.44 |

[a] Catalyst:DP-60 ratio of 1:6 (solids basis), and slurry pH of 3.0.

Example 6

Acquisition Layer (AL) Tests on Rayfloc-J Versus Porosanier Cross-Linked Sheets Using Belclene DP-60

Table 6 presents AL test results on AL pads made from Rayfloc-J and Porosanier-J-HP sheets (both of 300 gsm basis weight and 0.3 gsm/cc) that have been cross-linked in sheet form with DP-60.

With Porosanier sheets, DP-60 treatment levels of 2.4–4.7% were employed, while sheets of Rayfloc-J were treated with 4.1% of the chemical. The procedure utilized to apply the chemical was to dip, dry sheets into solutions of DP-60 at pH of 3.0 (solutions also contained 1:6 parts by weight of sodium hypophosphite catalyst to DP-60 solids). The sheets were then blotted & mechanically pressed to consistencies ranging from 44–47% prior to weighing. From the amount of solution remaining with the pulp sheet (oven dry basis), the amount of DP-60 chemical on oven dried ("o.d.") pulp can be calculated. The sheets were then transferred to a tunnel dryer to air dry overnight at about 50° C. and 17% relative humidity. The individual, air-dried pulp sheets were then placed into a forced draft oven at about 185° C. for 10 minutes to cure (i.e., cross-link) them with DP-60.

To compare the performance of the cross-linked samples to each other (and Controls) as well as the P&G AL material (obtained from Pampers® diapers), air-laid pads were first prepared from all the materials to approximately the same basis weight (100 gsm). The airlaid pads were then placed in the same location on NovaThin® diaper cores (manufactured by Rayonier). Three insults using 60 mls synthetic urine (0.9% saline) were performed. Acquisition time results for each of the 3 insults are presented in Table 6, along with rewet data. Rewet data were obtained as follows: thirty minutes after each insult, fluid rewet was obtained by placing a stack of pre-weighed filter papers over the impact insulted zone and placing a 0.7 psi load on top of the filter stack for two minutes; the filter stack was then weighed and the fluid uptake reported in grams.

Acquisition time performance is the primary criterion for judging the acceptability of a material for AL applications, with rewet being secondary (but still significant). The lower the values for both criterion, the better. Values resulting from the third insult are the most significant, because by then the system has reached a highly "stressed" state.

In Table 6, it is readily noted that Rayfloc cross-linked in sheet form gives very poor results compared with the commercial P&G AL material (cross-linked in "individualized" fibrous form). The insult time values were much improved over the Control Rayfloc sheet stock to which no cross-linking agent had been added (Sample #17).

In contrast to the Rayfloc results, sheets of Porosanier that had been cross-linked did very well relative to the commercial P&G AL material. Over the range of chemical added, the performance improved to the point that the sheeted sample cross-linked with 4.7% DP-60 (Sample #20) outperformed the P&G product (particularly when considering rewet values, which are markedly superior to the P&G product). It is also noted that the difference in the third "insult" time value of Sample #20 versus Control Porosanier (#21) is about 15 seconds, which is much greater than that seen for the sheeted Rayfloc counterparts (difference of only 6 seconds for Sample #16 versus #17).

TABLE 6

AL Test Results for Porosanier & Rayfloc Sheets (300 gsm) Cross-Linked with DP-60

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Rayfloc-J, Cross-Linked with 4.1% DP-60, #16 | 39.1 | 34.9 | 49.1 | 0.1 | 1.0 | 7.5 |
| Rayfloc-J, Control, #17; Through process, no DP-60 | 46.6 | 40.8 | 56.1 | 0.1 | 0.2 | 2.8 |
| Porosanier, Cross-Linked with 2.4% DP-60, #18 | 23.3 | 23.5 | 34.5 | 0.05 | 1.2 | 9.4 |
| Porosanier, Cross-Linked with 3.5% DP-60, #19 | 20.8 | 20.7 | 33.3 | 0.05 | 0.4 | 0.9 |
| Porosanier, Cross-Linked with 4.7% DP-60, #20 | 20.6 | 19.8 | 30.9 | 0.05 | 0.25 | 1.2 |
| Control Porosanier, #21; Through process, no DP-60 | 29.8 | 28.6 | 45.3 | 0.05 | 0.07 | 0.8 |
| P&G (Pampers ®) AL material | 23.8 | 22.7 | 29.4 | 0.04 | 0.4 | 6.8 |

Example 7

The Effect of Sheet Characteristics on Porosanier AL Performance

It was found that when Porosanier sheets of different basis weights were similarly treated with DP-60, AL performance were not uniform. Results on 600 and 150 basis weight sheets with average densities of 0.5 and 0.3 g/cc, respectively, that were cross-linked with 4.0% of DP-60 gave the AL test results shown below (Table 7). These results when contrasted with those above in Table 6 for samples #19 and #20 (DP-60 levels of 3.5 & 4.7%) and with the P&G AL material are definitely poorer.

The 150 gsm sheets which are thinner actually have the same average density as the 300 gsm Porosanier sheets used above to prepare samples #19 and #20 (i.e., 0.3 g/cc), and therefore would be expected to perform similarly. The poorer results were therefore perplexing.

TABLE 7

AL Test Results for Porosanier 600 & 300 gsm Sheets Cross-Linked with DP-60

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| 600 gsm (d = 0.5 g/cc), Cross-Linked with 4.0% DP-60, #22 | 30.7 | 25.7 | 39.3 | 0.06 | 1.4 | 9.4 |
| 150 gsm (d = 0.3 g/cc), Cross-Linked with 4.0% DP-60, #23 | 27.2 | 26.9 | 39.9 | 0.06 | 0.2 | 1.9 |

Upon close, visual examination of the sheets involved, it was noted that the 300 gsm sheets initially used (results reported in Table 6) clearly showed uneven and irregular sheet formation—clusters of fiber bundles or clumps are evident in some areas, whereas other areas are more open and porous in appearance. Overall, the sheet is much less uniform in density. Additionally, the sheet was softer than samples #22 and #23. These sheets were prepared without a refiner operation prior to sheeting on the pulp machine. Refiner action is normally used in Porosanier production to break up fiber clusters & evenly distribute the fibers onto the machine. Refiner use results in more uniform sheet formation and a sheet that is stronger ("tougher"). Both 600 & 150 gsm sheets were prepared using refiner action and therefore resulted in more uniform sheets.

Example 8

To further evaluate the affect of sheet formation on AL performance after cross-linking, two sets of Porosanier pulp sheets at 300 gsm and average densities of 0.3 g/cc were evaluated. One set was the sheets used initially above (Table 6) with irregular formation where refining was not used. The other represented uniform sheets prepared using the refiner during sheet formation.

Both sets of sheets were cross-linked with 4.2% of DP-60 using the methodology described above. They were then used to prepare air-laid, 100 gsm AL pads of the same density (0.06 g/cc) for testing. The AL test results are shown below (Table 8), where they are contrasted with the P&G test results seen above (Table 6, also conducted on 100 gsm pads at similar density [0.06 g/cc]). Results given represent the average of three replicate tests.

Results show substantially improved AL performance for the cross-linked material derived from the non-uniform 300 gsm sheets. The acquisition time values are much improved, and are essentially the same as results for the P&G product. Rewet results (the less significant criterion), however, while still superior to P&G AL material, appear to be not quite as good as those from cross-linked uniform sheets (i.e., the third rewet value is much higher).

Acquisition time results from the irregular 300 gsm sheets are noted to be very similar to those seen in Table 6 for samples #19 and #20 (both prepared from the same irregular 300 gsm sheet stock), whereas acquisition time results from the uniform 300 gsm sheets are very similar to those cross-linked samples above in Table 7 derived from 600 and 150 gsm uniform sheet stock (but of differing density).

TABLE 8

AL Test Results for Porosanier 300 gsm Sheets Cross-Linked with 4.2% DP-60: Non-Uniform versus Uniform Sheet Formation (same average density, 0.3 g/cc)

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Non-Uniform Sheets, #24 | 22.4 | 21.4 | 30.4 | 0.05 | 0.06 | 4.4 |
| Uniform Sheets, #25 | 27.4 | 26.8 | 39.5 | 0.06 | 0.16 | 1.6 |
| P&G (Pampers ®, AL Fiber) | 23.8 | 22.3 | 29.4 | 0.04 | 0.4 | 6.8 |

Example 9

Clearly, treatment of a sheet with a varied or less dense structure is preferable, since it has also been demonstrated that simply treating a low density, air-laid AL 100 gsm pad of Porosanier (0.07 g/cc) with only 3.5% of DP-60 chemical (by spray application), and then thermally cross-linking it in an "as-is" form gives results (Table 9 below) when tested "as-is" that also are similar to the P&G AL material in acquisition insult times, but outperform it on rewet properties. The results are very similar to those obtained for sample #19 above prepared with the same amount of chemical, but using the irregular, 300 gsm sheets (Table 6).

TABLE 9

AL Test Results for 100 gsm Porosanier AL Pad (0.07 g/cc density), Cross-Linked In Place with 3.5% DP-60

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Cross-Linked AL Pad, #26 | 25.7 | 22.3 | 31.8 | 0.07 | 0.07 | 1.2 |
| Cross-Linked 300 gsm, Irregular Sheets, #19 | 20.8 | 20.7 | 33.4 | 0.05 | 0.4 | 0.9 |
| P&G (Pampers ®, AL Fiber) | 23.8 | 22.3 | 29.4 | 0.04 | 0.4 | 6.8 |

Example 10

The best acquisition time test results, that easily outperform the P&G AL material, were obtained on Porosanier cross-linked with 4.1% of DP-60 in "individualized" fiber form using conventional methodology. Air-dried, Porosanier 600 gsm mill production sheets treated with 4.0% DP-60 solution were defiberized (fluffed) using the Kamas hammermill, prior to thermal curing (cross-linking) in a forced draft oven.

The results below (Table 10) are clearly superior in acquisition time to the P&G AL material, but are poorer in rewet properties.

TABLE 10

AL Test Results for Porosanier Cross-Linked with 4.0% of DP-60 in "Individualized" Fiber Form

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| "Individualized" Cross-Linked Fibers, #27 | 18.9 | 17.3 | 26.0 | 0.06 | 3.4 | 11.4 |
| P&G (Pampers ®) AL material | 23.8 | 22.3 | 29.4 | 0.04 | 0.4 | 6.8 |

Example 11

Comparison of Various Polycarboxylic Acid Chemicals in AL Performance of Cross-Linked, Sheeted Porosanier Experiments were carried out to examine the effect of cross-linking Porosanier in sheet form with various cross-linking chemicals. Belclene 200 and 283 PMA products were compared with the DP-60 product, as well as the Criterion 2000 polyacrylic acid (PAA) homopolymer product with average MW of 2250 (Vinings Industry). Porosanier, 150 gsm sheets (uniform formation) were treated with pH 3.0 solutions of each of these chemicals; solutions also contained 1:6 parts of sodium hypophosphite catalyst to chemical (solids basis). Sheets were then air-dried in a tunnel dryer overnight, and then thermally cured at 185° C. for 10 minutes. Next, air-laid AL pads were prepared (100 gsm with density about 0.07 g/cc) from each of these samples. The results of AL testing of pads derived from sheets cross-linked with about 6% of each chemical are shown below (Table 11).

TABLE 11

AL Test Results for Porosanier, 150 gsm Sheets Cross-Linked with About 6% of Various Polycarboxylic Acid Cross-Linking Agents

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Sheets Cross-Linked with 6.0% DP-60, #28 | 27.2 | 24.6 | 38.0 | 0.06 | 0.10 | 2.3 |
| Sheets Cross-Linked with 5.7% Belclene 200, #29 | 28.9 | 25.9 | 39.2 | 0.06 | 0.30 | 1.7 |
| Sheets Cross-Linked with 5.8% Belclene 283, #30 | 28.1 | 26.5 | 40.6 | 0.07 | 0.56 | 1.7 |
| Sheets Cross-Linked with 5.9% Criterion 2000, #31 | 26.6 | 23.9 | 40.5 | 0.06 | 0.93 | 6.5 |

The results are similar in acquisition time for all the chemicals evaluated except it appears that the PAA product (Criterion 2000) yields significantly poorer rewet properties. One notable advantage of the PAA product was that pulps prepared with it were less discolored.

Example 12

The PAA product and DP-60 were therefore further evaluated on the 300 gsm, irregular sheets (average density of 0.3 g/cc)—utilized above (see Tables 6, 8–9). The AL test results on air-laid pads prepared from these Porosanier sheets, cross-linked with 6.0 and 8.0% of DP-60 and Criterion 2000 are given below (Table 12). The air-laid AL pads were 100 gsm with densities in the 0.07–0.08 range.

The results show much better acquisition time performance for the DP-60 material than Criterion 2000 when using the irregular, 300 gsm sheets. The acquisition time results are just a little bit poorer than those seen in Tables 6 and 8 because the density of the AL pads used here are slightly higher. However, for some unexplained reason the third rewet value for the 6.0% DP-60 product appears poorer compared to its Criterion 2000 counterpart. At 8.0% dosage, the third rewet values are similar.

If the PAA material is blended with citric acid at the same levels present in DP-60 (which as noted above is a blend of a PMA terpolymer and citric acid), it is likely that it could perform as well in AL applications.

TABLE 12

AL Test Results for Porosanier 300 gsm, Non-Uniform Sheets Cross-Linked with 6.0% of DP-60 and Criterion 2000

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Sheets Cross-Linked with 6.0% DP-60, #32 | 24.1 | 24.6 | 32.4 | 0.04 | 0.24 | 11.3 |
| Sheets Cross-Linked with 8.0% DP-60, #33 | 25.1 | 23.0 | 31.5 | 0.05 | 0.05 | 3.4 |
| Sheets Cross-Linked with 6.0% Criterion 2000, #34 | 29.4 | 27.5 | 39.7 | 0.05 | 0.40 | 7.0 |
| Sheets Cross-Linked with 8.0% Criterion 2000, #35 | 28.1 | 26.7 | 37.9 | 0.05 | 0.16 | 2.9 |

Example 13

Evaluations of Placetate-F Sheets Cross-Linked with DP-60

Soft sheets of 300 gsm high purity (>95% cellulose), unmercerized Placetate-F with desirable "irregular" formation properties (average density of 0.3 g/cc) were treated and cross-linked with about 5–10% DP-60 using the methodology described above. Placetate-F is a southern pine sulfite pulp available from Rayonier (Fernandina, Fla.). Air-laid AL pads were then prepared (100 gsm, density around 0.08–0.09 g/cc) from these samples. The results of AL tests are presented below in Table 13.

TABLE 13

AL Test Results for Placetate-F, 300 gsm Sheets Cross-Linked with ~5–10% of DP-60.

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Sheets Cross-Linked with 4.8% DP-60, #36 | 37.3 | 33.9 | 50.3 | 0.05 | 0.49 | 3.2 |
| Sheets Cross-Linked with 7.5% DP--60, #37 | 34.4 | 31.7 | 44.8 | 0.04 | 1.84 | 7.5 |
| Sheets Cross-Linked with 9.6% DP-60, #38 | 28.9 | 29.0 | 44.9 | 0.04 | 0.57 | 6.4 |

These results are clearly inferior to those obtained with mercerized Porosanier fiber as seen in Examples 6 & 8. Use of mercerized fibers in cross-linking of sheets is paramount to attain adequate performance properties.

The results are much poorer than those for Porosanier cross-linked 300 gsm sheets, particularly when one considers DP-60 dosage rate. Even at a dosage of 9.6% DP-60 (Table 13) the third acquisition time has not yet reached 40 seconds.

Example 14

A bleached southern pine sulfite fiber was mercerized under the appropriate conditions (well known in the trade, i.e., appropriate combinations of caustic strength & temperature) to give fibers of high purity (about 98.8% α-cellulose content with average fiber length of 2.0 mm; Porosanier-J-HP fibers are 2.4 mm), designated here as Porosanier-F. Pulp sheets of about 330 gsm basis weight with ideal sheet formation characteristics (average density of 0.24 g/cc) were made and then cross-linked using 4.7% DP-60 using afore-described methodology. The cross-linked fibers were then evaluated in acquisition layer (AL) tests.

The results below (Table 14) for this cross-linked Porosanier-F product are contrasted with cross-linked Porosanier-J-HP material, sample #20 (Table 6) which was prepared using the same level of DP-60 (4.7%). These results are also contrasted with those for the P&G AL material.

As can be seen, mercerization results in cross-linked southern pine sulfite fibers which perform very well in AL tests. Results are not quite as good, however, for cross-linked Porosanier-F as for cross-linked Porosanier-J-HP (note the third acquisition time is about 5 seconds slower). The performance advantage for Porosanier-J-HP can probably be accounted for by the average fiber length difference between the two (i.e., 2.4 versus 2.0 mm).

TABLE 14

AL Test Results for Porosanier-J-HP vs. Porosanier-F, Cross-Linked with 4.7% of Belclene DP-60

| | Acquisition Time, seconds | | | Rewet Fluid Weight, g | | |
|---|---|---|---|---|---|---|
| Sample, No. (#) | 1st Insult | 2nd Insult | 3rd Insult | 1st Insult | 2nd Insult | 3rd Insult |
| Cross-Linked Porosanier-J-HP, #20 | 20.6 | 19.8 | 30.9 | 0.05 | 0.25 | 1.2 |

TABLE 14-continued

AL Test Results for Porosanier-J-HP vs. Porosanier-F, Cross-Linked with 4.7% of Belclene DP-60

| Sample, No. (#) | Acquisition Time, seconds | | | Rewet Fluid Weight, g | | |
|---|---|---|---|---|---|---|
| | 1st Insult | 2nd Insult | 3rd Insult | 1st Insult | 2nd Insult | 3rd Insult |
| Cross-Linked Porosanier-F, #39 | 25.2 | 22.7 | 34.7 | 0.04 | 0.24 | 1.9 |
| P&G (Pampers ®, AL material) | 23.8 | 22.7 | 29.4 | 0.04 | 0.4 | 6.8 |

Example 15

Performance Comparisons between Porosanier Sheets Cross-Linked with Varying Levels of Belclene DP-60 or Criterion 2000 Versus HBA in GATS Absorbent Tests, Centrifuge Retention Evaluations & in 20/80 Blends with Georgianier-J Another excellent application area for cross-linked fibers is as a bulking agent for standard paper pulps to provide porosity, improved absorbance, and bulk to a web of the blended fibers. The cross-linked product must also provide resistance to wet collapse of the blended fiber structure (i.e., good wet resiliency). In filters, the increased bulk yields increased air permeability. In filter applications, it is also very important that "nits" be minimized since they negatively affect surface appearance. When used in toweling, cross-linked fibers can furnish a dramatic increase in liquid holding capacity and absorbency rate.

The most popular commercial material utilized in the industry today to accomplish the above is Weyerhaueser's HBA. This material is prepared by cross-linking standard paper pulp with DMDHEU in an "individualized" fiber form, so the final product is a "fluff-like" product of low density. Due to the chemistry utilized (urea chemistry, with lower cure temperatures—typically around 140° C.) the product has poorer absorbent rate performance (see, for example, Table 4 above) when compared with carboxylic acid mixtures such as DP-60, as well as higher "knot" levels when compared to use of polymaleic acids (see Example 7 in U.S. Pat. No. 5,998,511).

The industry would like to have a material that is in sheeted, roll-good form, that is not dusty (many complain about the dustiness of HBA), a material that is relatively "nit" free (so their finished blended products have good surface appearance), and a product that has better absorbent properties. This instant invention can deliver all of these.

As mentioned above, the Criterion 2000 PAA material gives a cross-linked sheeted Porosanier product that is less discolored after the thermal curing step than the Belclene DP-60 product. In spite of the fact that it does not appear to do as well in AL applications when compared with DP-60, we have found that it does equally well in terms of its GATS absorbent properties relative to DP-60 at similar dosage levels (Table 15, below). Both materials are found to perform better than HBA in absorbent rate. The capacity value for HBA appears high in the comparative evaluations below, but this is a less significant performance criterion.

In test results below, the GATS absorbency rates were carried out by a standard radial wicking procedure using pads pressed to a 0.1 g/cc density and tested under a 0.05 psi load for 7 minutes. For the GATS fluid retention (maximum capacity) determinations reported below, a standard multi-port procedure was used with pads pressed to 0.1 g/cc density and under a 0.05 psi load for a time period of 850 seconds (14.2 minutes). The sheet stocks evaluated for this work were all derived from cross-linking the soft, non-uniform 300 gsm Porosanier sheets discussed above (average density of 0.3 g/cc).

TABLE 15

Comparative GATS Absorbent Results for Porosanier Sheets (non-uniform, 300 gsm) Cross-Linked with DP-60 Or Criterion 2000, and HBA

| Sample, No. (#) | Absorption Rate (g/g/sec) | Maximum Capacity (g/g) |
|---|---|---|
| 3.5% DP-60, #19 | 0.38 | N.D.[a] |
| 4.7% DP-60, #20 | 0.44 | N.D.[a] |
| 6.0% DP-60, #32 | 0.43 | 10.8 |
| 8.0% DP-60, #33 | 0.51 | 10.3 |
| 10% DP-60, #40 | 0.53 | 10.4 |
| 15% DP-60, #41 | 0.61 | N.D.[a] |
| 20% DP-60, #42 | 0.64 | N.D.[a] |
| 25% DP-60, #43 | 0.72 | N.D.[a] |
| 6.0% Criterion 2000, #34 | 0.45 | 11.1 |
| 8.0% Criterion 2000, #35 | 0.49 | 10.8 |
| 10.0% Criterion 2000, #44 | 0.53 | 10.7 |
| HBA | 0.35 | 12.0 |

[a]N.D. = not determined.

The results show that both the DP-60 and Criterion 2000 materials perform very nearly the same in the 6–10% dosage range. Absorption rates are noted to continue to increase as the dosage of chemical used for cross-linking is increased; this increased performance did not appear to result in improved AL performance, however, when compared to samples cross-linked in the 4–6% range with DP-60 (compare data in Tables 6 and 8 with those in Table 12).

Clearly, if high permeation rate fibers (i.e., fibers with fact absorption rates) are desired for other applications, the data in Table 15 indicates that simply increasing the quantity of cross-linker improves performance.

Example 16

It is important that candidate materials to replace HBA resist wet-collapse. This is typically evaluated by examining the water retention after centrifuging. Because they are "stiffer", cross-linked fibers absorb fluids more readily, and under a load (e.g., centrifugal force) lose fluid more easily because the network of fibers does not collapse and trap solution within the matrix. Relative water retention is examined by putting two grams of the fiber (in defiberized, "fluff" form) into a cloth teabag and sealing it. The teabag is then placed into a 0.9% saline solution and allowed to soak for 30 minutes before removing it and hanging it up to drip-dry for 10 minutes. Next, the bags are placed in a centrifuge and spun for 5.0 minutes at 1400 rpm. The bags are then weighed, and the amount of solution remaining is used to calculate retention after centrifuging. Several of the products above were tested, along with Porosanier Control, for comparison with HBA. The results are given below (Table 16).

TABLE 16

Relative Centrifuge, Water Retention Values on Cross-Linked Porosanier

| Sample, No. # | Water Retention Value (g/g) |
|---|---|
| Porosanier Control, #21 | 1.01 |
| 3.5% DP-60, #19 | 0.58 |
| 6.0% DP-60, #32 | 0.46 |
| 6.0% Criterion 2000, #34 | 0.43 |
| HBA | 0.61 |

The results show that at 6.0% dosage, both cross-linking chemicals give products that outperform HBA in their ability to resist wet collapse using this test. At 3.5% of DP-60, results more nearly approaching those of HBA. Clearly, the Porosanier Control (through process, but no added chemicals) performs poorly relative to the cross-linked materials.

Example 17

Selected, cross-linked Porosanier pulp sheets cited above (Tables 15 & 16) were wet blended with 80% Georgianier-J and sheeted. The sheeted blends, pressed and unpressed, were tested for bulk, porosity and tensile strength. Comparative data is also provided for sheets made by wet blending HBA with Georgianier-J pulp. Additionally, handsheets of 100% Georgianier-J were evaluated to provide a baseline for comparison. Results are presented in Table 17 below.

TABLE 17

Evaluations of 20/80 Blends of Cross-Linked Porosanier Sheets (non-uniform, 300 gsm) and HBA with Georgianier-J for Bulk, Porosity, & Tensile Strength

| Sample No. of 20/80 Blend | Cross-Linked Pulp Description (Sample #) | Bulk (cc/g) Unpressed | Bulk (cc/g) Pressed | Porosity $mL/cm^2/sec$ | Tensile N |
|---|---|---|---|---|---|
| 45 | 4.7% DP-60 (#20) | 5.44 | 3.02 | 56.7 | 6.1 |
| 46 | 6.0% DP-60 (#32) | 5.68 | 3.24 | 60.1 | 6.0 |
| 47 | 6.0% Criterion 2000 (#34) | 6.12 | 3.33 | 63.0 | 6.4 |
| 48 | HBA | 6.07 | 3.85 | 56.3 | 5.1 |
| 49 | 100% Georgianier | 4.68 | 2.49 | 36.6 | 10.9 |

The results above show good bulking ability for the product cross-linked with 6% of the PAA material (Criterion 2000) relative to HBA. It also appears to be slightly better than DP-60 in pressed bulk as well, but not as good as HBA. However, in porosity values the results for both the 6% products cross-linked with either DP-60 or PAA are superior to HBA, while tensile strength values are better than HBA for all of the cross-linked Porosanier products tested.

Example 18

Formation properties of the hand sheets were also examined. It was noted that the handsheets containing cross-linked Porosanier were free of "nits", unlike those made with HBA. The results are visually dramatic. The handsheets made with HBA had highly blemished surface irregularities. In contrast, the handsheet blends made with the cross-linked mercerized fibers of the invention are surface smooth, with sheet structure appearing very uniform.

Johnson Fiber Classification Results

Representative control and cross-linked samples cited above were submitted to fiber classification using a Johnson Classifier. In the Johnson Classifier, a sample in fluff form prepared by defiberizing in a Kamas hammermill is continuously dispersed in an air stream. During dispersion, loose fiber passes through a 14 mesh screen (1.18 mm) and then through a 42 mesh (0.2 mm) screen. Pulp bundles (knots) which remain in the dispersion chamber and those that get trapped on the 42 mesh screen are removed and weighed. The former are called "knots" and the latter "accepts". The combined weight of these two is subtracted from the original weight to determine the weight of fibers that passed through the 0.2 mm screen. These fibers are referred to as "fines".

The results are reported below in Tables 18, 18A & 19. The "knots" fraction was then examined to determine the nature of the material (e.g., either "nits" or fibrous fluff "balls" consisting of individual fibers—water dispersible, or mixtures of both).

Table 18 contains the results for representative samples prepared from the soft non-uniform 300 gsm Porosanier sheets having a density of 0.3 gm/cc. Also shown are comparative data for HBA, P&G AL material, and cross-linked Rayfloc-J sheets, along with appropriate Controls.

Table 18A provides Johnson Classifier results for 800 gsm Porosanier sheet having a density of 0.45 g/cc, cross-linked with Belclene® DP-60 and DP-80, and 690 gsm Rayfloc sheets of the same density, cross-linked with Belclene® DP-60. Comparative results are provided for an identical 800 gsm Porosanier sheet and a 690 gsm Rayfloc sheet processed in the same manner, but not treated with cross-linking agent.

TABLE 18

Johnson Classifier Results on Cross-Linked Porosanier 300 gsm Sheets (soft, non-uniform formation), Commercial Products, & Cross-linked Rayfloc-J Sheets

| Sample, No. (#) | % Knots | % Accepts | % Fines | Nature of Knots Fraction |
|---|---|---|---|---|
| Porosanier, Cross-Linked | | | | |
| with 3.5% DP-60, #19 | 1.9 | 91.9 | 6.2 | Balls |
| with 4.2% DP-60, #24 | 1.5 | 92.8 | 5.7 | Balls |
| with 6.0% DP-60, #32 | | | | Balls |
| with 6.0% Criterion 2000, #34 | | | | Balls |
| Control, through process, not Cross-Linked, #21 | 2.8 | 91.2 | 5.9 | Balls |
| Rayfloc, Cross-Linked with 4.1% DP-60, #16 | 3.4 | 83.3 | 13.4 | Nits |
| Rayfloc Control; through process, not Cross-Linked, #17 | 1.7 | 89.1 | 9.1 | Nits |
| P&G (Pampers ®) AL material | 13.8 | 80.3 | 5.9 | Combination |
| HBA | 11.9 | 82.1 | 6.0 | Combination |

TABLE 18A

Johnson Classifier Results on Porosanier (0.45 g/cc, 800 gsm) Sheets (non-uniform formation) & Rayfloc-J (0.45 g/cc, 690 gsm) Sheets

| Sample, No (#) | % Knots | % Accepts | % Fines | Nature of Knots Fraction |
|---|---|---|---|---|
| 800 gsm Porosanier, Cross-Linked with 4.8% of DP-60 (#53) | 3.6 | 90.4 | 6.0 | Balls |

TABLE 18A-continued

Johnson Classifier Results on Porosanier (0.45 g/cc, 800 gsm) Sheets (non-uniform formation) & Rayfloc-J (0.45 g/cc, 690 gsm) Sheets

| Sample, No (#) | % Knots | % Accepts | % Fines | Nature of Knots Fraction |
|---|---|---|---|---|
| 800 gsm Porosanier Control; through process, not Cross-Linked (#54) | 3.9 | 90.9 | 5.2 | Balls |
| 690 gsm Rayfloc, Cross-Linked with 4.9% of DP-60 (#55) | 14.9 | 73.7 | 11.4 | Nits |
| 690 gsm Rayfloc Control; through process, not Cross-Linked (#56) | 5.9 | 90.9 | 3.1 | Nits |
| 800 gsm Porosanier, Cross-Linked with 4.8% of DP-80 (#57) | 4.0 | 91.2 | 4.8 | Balls |
| 800 gsm Porosanier Control; through process, not Cross-Linked (#54) | 3.9 | 90.9 | 5.2 | Balls |

All of the "knot" fractions collected from samples derived from the soft 300 gsm and the 800 gsm Porosanier sheets contain no "nits"—hard fiber bundles that do not disperse in wet blending. The cross-linked 300 gsm Porosanier sheets had fewer knots than the Control Porosanier sheet which was subjected to the same processing but not cross-linked. With 800 gsm Porosanier sheets the percentage of knots was either slightly reduced or was essentially the same in the cross-linked sheets as in the same sheets processed without a cross-linking agent.

As shown in Tables 18 and 18A, the knot content went up by at least 200% when Rayfloc cellulosic fibers were cross-linked in sheet form. Additionally, fines after processing in the Johnson Classifier were notably greater for the cross-linked Rayfloc samples than for the Rayfloc Controls (probably due to increased fiber brittleness upon cross-linking). The knots in the Rayfloc-J samples are also noted to be "nits". Both HBA and the P&G knot fractions contain a combination of "nits" and "balls".

Because "knot" fractions derived from the cross-linked, soft Porosanier 300 gsm sheets contain only water dispersible fluff "balls", blending this material with Georgianier-J produces handsheets which are "nit" free with a superior surface appearance relative to HBA blends.

The Johnson Classifier results in Table 19 were all obtained on various cross-linked samples prepared from Porosanier with uniform, homogeneous sheet formation (stronger, tougher sheets than the soft sheets with non-uniform formation). The results were all strikingly different in one respect. All of the "knot" fractions that were obtained were found to be "nits" (most likely cross-linked fiber bundles) not "balls"—that could be broken up and dispersed in water. When these uniform sheets are used in wet blending applications, where they might compete against products containing HBA, they are cosmetically inferior to cross-linked non-uniform sheets of mercerized fiber which do not contain nits.

TABLE 19

Johnson Classifier Results on Cross-Linked Porosanier Sheets With Uniform Sheet Formation

| Sample, No. (#) | % Knots | % Accepts | % Fines | Nature of Knots Fraction |
|---|---|---|---|---|
| 300 gsm sheet with 4.4% DP-60, #25 | 1.81 | 90.3 | 7.9 | Nits |
| 150 gsm sheet with 4.0% DP-60, #23 | 1.0 | 93.0 | 6.0 | Nits |
| 150 gsm sheet with 4.0% Criterion 2000, #50 | 0.8 | 92.4 | 6.8 | Nits |
| 150 gsm sheet with 5.7% Belclene 200, #29 | 0.8 | 92.4 | 6.8 | Nits |
| 150 gsm sheet Control, #51; not through process | 2.2 | 92.8 | 5.0 | Nits |
| 150 gsm sheet Control, #52; through process, not Cross-Linked | 2.2 | 92.2 | 5.6 | Nits |

The fact that "nits" were observed on the two 150 gsm Porosanier Controls sheets (Samples #51 and #52 in Table 19—no cross-linking chemicals added) where a refiner was used to obtain the uniform sheet structure, suggests that refiner action causes fibers to bind together to a greater extent. In any event, it was surprising to find that mercerized cellulosic fibers cross-linked in sheet form without prior refining had superior appearance and absorption properties than sheets which were refined prior to cross-linking.

As shown in Table 18A, when conventional fluff pulp is cross linked in sheet form, the percentage of knots in the sheet can increase by nearly a factor of 2.5, i.e. from 5.9% to 14.9%. An increased percentage of knots in a crossed-linked cellulosic fiber sheet reflects significant interfiber cross-linking. Further, the percentage of fines produced when a cross-linked Rayfloc sheet is fluffed for classification is substantially higher than when a pulp sheet of the same material which has not been cross-linked is subjected to fluffing for the Johnson Classifier. As shown in Tables 18 and 18A, the percentage of fines from a 300 gsm Rayfloc sheet increased from 9.1% to 13.4% with cross-linking, and from 3.1% to 11.4% for a 690 gsm Rayfloc sheet. This increased percentage of fines is also an indication of substantial interfiber cross-linking, since interfiber cross-linking renders the cross-linked fibers in a sheet brittle and results in increased fiber breakage, yielding fines, when the sheet is fluffed using a Kamas hammermill, prior to fiber classification analysis.

As shown in Tables 18, 18A & 19, when cross-linked high purity mercerized cellulosic fibers are cross-linked in sheet form, the percentage of knots in the sheet actually decreases if the sheet has a basis weight of 300 gsm, and is slightly reduced or essentially unchanged when the mercerized sheet has a substantially higher basis weight. When a sheet of cross-linked high purity mercerized cellulosic fibers is fluffed, the percentage of fines resulting is essentially the same as when an identical but uncrossed-linked sheet is processed in the same way, or in the case of sheets having basis weights over 600 gsm, only slightly increased. The percentage of fines resulting from the processing of cross-linked high purity mercerized cellulosic fiber sheets according to this invention in a Johnson Classifier, relative to identical but uncross-linked sheets is not more than 50% greater, and preferably not more then 30% greater, and most preferably not more than 20% greater.

Basis weight and density are important considerations in the selection of cellulose fiber sheets for commercial applications. Because sheets of higher basis weights typically have fibers which are more densely packed, its recognized that they will naturally have a higher percentage of knots than cellulosic fiber sheets having lower basis weights. In similar fashion, because cellulosic fiber sheets having higher basis weights have higher degrees of fiber interconnection, it is also recognized they tend to produce larger amounts of fines when they are defiberized or fluffed, such as for example for classification in a Johnson Classifier.

Regardless of the basis weight of a cellulosic fiber sheet intended for a fluid absorption application, it is considered undesirable for chemical cross-linking of the cellulosic fibers in the sheet to substantially increase its percentage of knots and/or fines. Since increased knots and fines percentage are associated with interfiber cross-linking, cross-linking of cellulosic fibers in sheet form which does not materially increase the percentage of knots and/or fines can be attributed to having achieved substantial intrafiber cross-linking of the cellulosic fibers of the sheet, without substantial interfiber cross-links. Since higher basis weight cellulosic fiber sheets naturally have a higher percentage of knots and fines than lower basis weight sheets, the degree to which a cellulosic fiber sheet has been subjected to intrafiber cross-linking, as opposed to interfiber cross-linking must be judged in a relative sense based on whether the percentage of knots and/or fines in the sheet have been increased by fiber cross-linking.

We have found that the absorbency characteristics of mercerized cellulosic fibers which are cross-linked in sheet form are most improved when the character of the cross-linking is such that the cellulosic fibers have substantial intrafiber cross-linking, without substantial interfiber cross-links. In a cross-linked sheet of mercerized cellulosic fibers, the presence of substantial intrafiber cross-linking, without substantial interfiber cross-links is evidenced by a "Fiber Knot Ratio" which is not greater than about 1.5, and preferably not greater than about 1.2, and most preferably not greater than about 1.1, where the Fiber Knot Ratio is calculated as follows:

$$\text{Fiber Knot Ratio} = \frac{\text{Percentage of Knots in Cross-Linked Mercerized Cellulosic Fiber Sheet}}{\text{Percentage of Knots in Mercerized Cellulosic Fiber Sheet Without Cross-Linking}}$$

For purposes of determining the percentage of knots in a cellulosic fiber sheet for calculation of the Fiber Knot Ratio, the fiber sheets are subjected to fiber classification using a Johnson Classifier, after fluffing in a Kamas hammermill. The cross-linked and uncross-linked sheets used to determine the Fiber Knot Ratio are identical other than with respect to cross-linking.

We have also determined that the presence of substantial intrafiber cross-linking, without substantial interfiber cross-links in a sheet of mercerized cellulosic fibers is further evidenced by a "Fines Ratio" of not greater than about 1.5, and preferably not greater than about 1.3, and most preferably not greater than about 1.2, where the Fines Ratio is calculated as follows:

$$\text{Fines Ratio} = \frac{\text{Percentage of Fines in Cross-Linked Mercerized Cellulosic Fiber Sheet after fluffing for Fiber Classification}}{\text{Percentage of Fines in Mercerized Cellulosic Fiber Sheet Without Cross-Linking after fluffing for Fiber Classification}}$$

For purposes of calculating the Fines Ratio, the percentage of fines in otherwise identical uncross-linked and cross-linked mercerized cellulosic fiber sheets is determined by classification in a Johnson Classifier, after fluffing in a Kamas hammermill.

The presence of substantial intrafiber cross-linking without substantial interfiber cross-links in a mercerized cellulosic fiber sheet, which is associated with superior liquid absorption properties as described in this application, is associated with cross-linked mercerized cellulosic fiber sheets having Fiber Knot Ratios and Fines Ratios not greater than about 1.5.

While we have described what are presently believed to be the preferred embodiments of our invention, those skilled in the art will recognize that changes and modifications may be made thereto without departing from the spirit of the invention, and we intend to claim all such changes and modifications as fall within the true scope of the invention.

We claim:

1. A method for preparing cross-linked cellulosic fibers in sheet form, the method comprising:

(a) applying a polymeric carboxylic acid cross-linking agent to a wet laid sheet of mercerized cellulosic fibers; and (b) curing the cross-linking agent on said sheet of mercerized cellulosic fibers to form a sheet of cross-linked cellulosic fibers having substantial intrafiber cross-links without substantial interfiber cross-links and a Fiber Knot Ratio not greater than about 1.2.

2. The method of claim 1, wherein the α-cellulose purity of the mercerized cellulosic fibers is at least 95%.

3. The method of claim 2, wherein the Fiber Knot Ratio of said sheet is not greater than about 1.1.

4. The method of claim 1, wherein said mercerized cellulosic fibers in said wet laid sheet are free of mechanical refining.

5. The method of claim 4, wherein the polymeric carboxylic acid cross-linking agent comprises a homopolymer of maleic acid monomer, a copolymer of maleic acid monomer, a terpolymer of maleic acid monomer or a mixture thereof.

6. The method of claim 1, wherein the polymeric carboxylic acid cross-linking agent comprises a homopolymer of maleic acid-monomer, a copolymer of maleic acid monomer, a terpolymer of maleic acid monomer or a mixture thereof.

7. The method of claim 5, wherein the polymeric carboxylic acid cross-linking agent has an average molecular weight from about 400 to about 10000.

8. The method of claim 6, wherein the polymeric carboxylic acid cross-linking agent has an average molecular weight from about 400 to about 10000.

9. The method of claim 7, wherein the polymeric carboxylic acid cross-linking agent has a pH from about 2.5 to about 3.5.

10. The method of claim 8, wherein the polymeric carboxylic acid cross-linking agent has a pH from about 2.5 to about 3.5.

11. The method of claim 1, wherein the cross-linking agent comprises a $C_2$–$C_9$ polycarboxylic acid.

12. The method of claim 3, wherein the cross-linking agent comprises a $C_2$–$C_9$ polycarboxylic acid.

13. The method of claim 1, wherein said sheet of cross-linked cellulosic fibers has a Fines Ratio not greater than about 1.3.

14. The method of claim 4, wherein said sheet of cross-linked cellulosic fibers has a Fines Ratio not greater than about 1.2.

15. A method of preparing a sheet of cross-linked cellulosic fibers having superior liquid acquisition and rewet properties, the method comprising:

(a) forming a wet laid sheet of mercerized cellulosic fiber;

(b) applying a polymeric carboxylic acid cross-linking agent to said sheet of mercerized cellulosic fibers to form a sheet impregnated with the cross-linking agent; and (c) curing the cross-linking agent on said impregnated sheet of mercerized cellulosic fibers to form a sheet of cross-linked cellulosic fibers having substantial intrafiber cross-links without substantial interfiber cross-links and a Fiber Knot Ratio not greater than about 1.2.

16. The method of claim 15, wherein the impregnated sheet produced in step (b) is dried prior to step (c).

17. The method of claim 16, wherein said mercerized cellulosic fibers used to form said wet laid sheet are free of mechanical refining.

18. The method of claim 17, wherein said sheet of cross-linked cellulosic fibers has a Fiber Knot Ratio not greater than about 1.1.

* * * * *